US005268044A

United States Patent [19]

Hemphill et al.

[11] Patent Number: 5,268,044

[45] Date of Patent: Dec. 7, 1993

[54] HIGH STRENGTH, HIGH FRACTURE TOUGHNESS ALLOY

[75] Inventors: Raymond M. Hemphill, Wyomissing; David E. Wert, West Lawn; Paul M. Novotny, Mohnton; Michael L. Schmidt, Wyomissing, all of Pa.

[73] Assignee: Carpenter Technology Corporation, Reading, Pa.

[21] Appl. No.: 861,977

[22] PCT Filed: Feb. 5, 1991

[86] PCT No.: PCT/US91/00779

§ 371 Date: Jun. 30, 1992

§ 102(e) Date: Jun. 30, 1992

Related U.S. Application Data

[63] Continuation-in-part of Ser. No. 475,773, Feb. 6, 1990, Pat. No. 5,087,415.

[51] Int. Cl.[5] ..... C22C 38/52

[52] U.S. Cl. ..... 148/328; 148/335; 420/95; 420/96; 420/97; 420/107; 420/108

[58] Field of Search ..... 148/328, 335; 420/97, 420/96, 95, 107, 108

[56] References Cited

U.S. PATENT DOCUMENTS

| | | | |
|---|---|---|---|
| 3,502,462 | 3/1970 | Dabkowski et al. | 420/95 |
| 3,585,011 | 6/1971 | Matas et al. | 428/638 |
| 4,076,525 | 2/1978 | Little et al. | 420/95 |
| 4,152,148 | 5/1979 | Machmeier | 420/107 |

FOREIGN PATENT DOCUMENTS

| | | |
|---|---|---|
| 2008423 | 5/1969 | France . |
| 1159969 | 11/1966 | United Kingdom . |

OTHER PUBLICATIONS

L. Luyckx et al., "Sulfide Shape Control in High Strength Low Alloy Steels", *Metallurgical Transactions*, vol. 1 (Dec. 1970), No. 3341.

W. M. Garrison, Jr., "Ultrahigh-Strength Steels for Aerospace Applications", *JOM* (May 1990).

L. Luyckx et al., "Current Trends in the Use of Rare Earths in Steelmaking", *Electric Furnace Proceedings*, (1973).

P. E. Waudby, "Rare Earth Additions to Steel", *International Metals Reviews*, (1978) No. 2.

*Primary Examiner*—Deborah Yee

*Attorney, Agent, or Firm*—Dann, Dorfman, Herrell and Skillman

[57] ABSTRACT

A high strength, high fracture toughness steel alloy consisting essentially of, in weight percent, about

| | |
|---|---|
| C | 0.2–0.33 |
| Mn | 0.20 max. |
| Si | 0.1 max. |
| P | 0.008 max. |
| S | 0.004 max. |
| Cr | 2–4 |
| Ni | 10.5–15 |
| Mo | 0.75–1.75 |
| Co | 8–17 |
| Ce | Effective amount–0.030 |
| La | Effective amount–0.01 |
| Fe | Balance |

and an article made therefrom are disclosed. A small but effective amount of calcium can be present in this alloy in substitution for some or all of the cerium and lanthanum. The alloy is an age-hardenable martensitic steel alloy which provides a unique combination of tensile strength and fracture toughness. The alloy provides excellent mechanical properties when hardened by vacuum heat treatment with inert gas cooling and has a low ductile-to-brittle transition temperature.

27 Claims, No Drawings

HIGH STRENGTH, HIGH FRACTURE TOUGHNESS ALLOY

This application is a continuation-in-part of application Ser. No. 07/475,773, filed on Feb. 6, 1990, now U.S. Pat. No. 5,087,415 and assigned to the assignee of the present application.

BACKGROUND OF THE INVENTION

This invention relates to an age-hardenable, martensitic steel alloy, and in particular to such an alloy and an article made therefrom in which the elements are closely controlled to provide a unique combination of high tensile strength, high fracture toughness and good resistance to stress corrosion cracking in a marine environment.

Heretofore, an alloy designated as 300M has been used in structural components requiring high strength and light weight. The 300M alloy has the following composition in weight percent:

| | wt. % |
|---|---|
| C | 0.40–0.46 |
| Mn | 0.65–0.90 |
| Si | 1.45–1.80 |
| Cr | 0.70–0.95 |
| Ni | 1.65–2.00 |
| Mo | 0.30–0.45 |
| V | 0.05 min. |

and the balance is essentially iron. The 300M alloy is capable of providing tensile strength in the range of 280–300 ksi.

A need has arisen for a high strength alloy such as 300M but having high fracture toughness as represented by a stress intensity factor, $K_{IC}, \geqq 100$ ksi $\sqrt{in}$. The fracture toughness provided by the 300M alloy, represented by a $K_{IC}$ of about 55–60 ksi $\sqrt{in}$, is not sufficient to meet that requirement. Higher fracture toughness is desirable for better reliability in components and because it permits non-destructive inspection of a structural component for flaws that can result in catastrophic failure.

An alloy designated as AF1410 is known to provide good fracture toughness as represented by $K_{IC} \geqq 100$ ksi $\sqrt{in}$. The AF1410 alloy is described in U.S. Pat. No. 4,076,525 ('525) issued to Little et al. on Feb. 28, 1978. The AF1410 alloy has the following composition in weight percent, as set forth in the '525 patent:

| | wt. % |
|---|---|
| C | 0.12–0.17 |
| Mn | .05–.20 |
| S | 0.005 max. |
| Cr | 1.8–3.2 |
| Ni | 9.5–10.5 |
| Mo | 0.9–1.35 |
| Co | 11.5–14.5 |
| REM | 0.01 max. |

REM = rare earth metals and the balance is essentially iron. The AF1410 alloy, however, leaves much to be desired with regard to tensile strength. It is capable of providing ultimate tensile strength up to 270 ksi, a level of strength not suitable for highly stressed structural components in which the very high strength to weight ratio provided by 300M is required. It would be very desirable to have an alloy which provides the good fracture toughness of the AF1410 alloy in addition to the high tensile strength provided by the 300M alloy.

SUMMARY OF THE INVENTION

Accordingly, it is a principal object of this invention to provide an age-hardenable, martensitic steel alloy and an article made therefrom which are characterized by a unique combination of high tensile strength and high fracture toughness.

More specifically, it is an object of this invention to provide such an alloy which is characterized by significantly higher tensile strength than provided by the AF1410 alloy while still maintaining high fracture toughness.

A further object of this invention is to provide an alloy which, in addition to high strength and high fracture toughness, is designed to provide high resistance to stress corrosion cracking in marine environments.

Another object of this invention is to provide a high strength alloy having a low ductile-to-brittle transition temperature.

The foregoing, as well as additional objects and advantages of the present invention, are achieved in an age-hardenable, martensitic steel alloy as summarized in Table I below, containing in weight percent, about:

TABLE I

| | Broad | Intermediate | Preferred |
|---|---|---|---|
| C | 0.2–0.33 | 0.20–0.31 | 0.21–0.27 |
| Mn | 0.20 max. | 0.15 max. | 0.05 max. |
| S | 0.0040 max. | 0.0025 max. | 0.0020 max. |
| Cr | 2–4 | 2.25–3.5 | 2.5–3.3 |
| Ni | 10.5–15 | 10.75–13.5 | 11.0–12.0 |
| Mo | 0.75–1.75 | 0.75–1.5 | 1.0–1.3 |
| Co | 8–17 | 10–15 | 11–14 |
| Ce | small but effective amount up to 0.030 | small but effective amount up to 0.030 | 0.01 max. |
| La | small but effective amount up to 0.01 | small but effective amount up 0.01 | 0.005 max. |
| Fe | Bal. | Bal. | Bal. |

The balance may include additional elements in amounts which do not detract from the desired combination of properties. For example, about 0.1% max. silicon, about 0.02% max. titanium, about 0.01% max. aluminum, and not more than about 0.008% phosphorus may be present in this alloy.

The foregoing tabulation is provided as a convenient summary and is not intended to restrict the lower and upper values of the ranges of the individual elements of the alloy of this invention for use solely in combination with each other, or to restrict the broad, intermediate or preferred ranges of the elements for use solely in combination with each other. Thus, one or more of the broad, intermediate, and preferred ranges can be used with one or more of the other ranges for the remaining elements. In addition, a broad, intermediate, or preferred minimum or maximum for an element can be used with the maximum or minimum for that element from one of the remaining ranges. Here and throughout this application percent (%) means percent by weight, unless otherwise indicated.

The alloy according to the present invention is critically balanced to provide a unique combination of high tensile strength, high fracture toughness, and stress corrosion cracking resistance. For example, the ratio Ce/S is at least about 2 to not more than about 15, preferably not more than about 10. When more than about 1.3% molybdenum is present in this alloy, the amount of carbon and/or cobalt are preferably adjusted downwardly so as to be within the lower half of their respective elemental ranges. Carbon and cobalt are preferably balanced in accordance with the following relationships:

a) % Co≦35-81.8(% C);

b) % Co≧25.5-70(% C); and, for best results c) % Co≧26.9-70(% C).

DETAILED DESCRIPTION

The alloy according to the prevent invention contains at least about 0.2%, better yet, at least about 0.20%, and preferably at least about 0.21% carbon because it contributes to the good hardness capability and high tensile strength of the alloy primarily by combining with other elements such as chromium and molybdenum to form carbides during heat treatment. Too much carbon adversely affects the fracture toughness of this alloy. Accordingly, carbon is limited to not more than about 0.33%, better yet, to not more than about 0.31%, and preferably to not more than about 0.27%.

Cobalt contributes to the hardness and strength of this alloy and benefits the ratio of yield strength to tensile strength (Y.S./U.T.S.). Therefore, at least about 8%, better yet at least about 10%, and preferably at least about 11% cobalt is present in this alloy. For best results at least about 12% cobalt is present. Above about 17% cobalt the fracture toughness and the ductile-to-brittle transition temperature of the alloy are adversely affected. Preferably, not more than about 15%, and better yet not more than about 14% cobalt is present in this alloy.

Cobalt and carbon are critically balanced in this alloy to provide the unique combination of high strength and high fracture toughness that is characteristic of the alloy. Thus, to ensure good fracture toughness, carbon and cobalt are preferably balanced in accordance with the following relationship:

a) % Co≦35-81.8(% C).

To ensure that the alloy provides the desired high strength and hardness, carbon and cobalt are preferably balanced such that:

b) % Co≧25.5-70(% C); and, for best results c) % Co≧26.9-70(% C).

Chromium contributes to the good hardenability and hardness capability of this alloy and benefits the desired low ductile-brittle transition temperature of the alloy. Therefore, at least about 2%, better yet at least about 2.25%, and preferably at least about 2.5% chromium is present. Above about 4% chromium the alloy is susceptible to rapid overaging such that the unique combination of high tensile strength and high fracture toughness is not attainable with the preferred age-hardening heat treatment. Preferably, chromium is limited to not more than about 3.5%, and better yet to not more than about 3.3%. When the alloy contains more than about 3% chromium, the amount of carbon present in the alloy is adjusted upwardly in order to ensure that the alloy provides the desired high tensile strength.

At least about 0.75% and preferably at least about 1.0% molybdenum is present in this alloy because it benefits the desired low ductile-brittle transition temperature of the alloy. Above about 1.75% molybdenum the fracture toughness of the alloy is adversely affected. Preferably, molybdenum is limited to not more than about 1.5%, and better yet to not more than about 1.3%. When more than about 1.3% molybdenum is present in this alloy the % carbon and/or % cobalt must be adjusted downwardly in order to ensure that the alloy provides the desired high fracture toughness. Accordingly, when the alloy contains more than about 1.3% molybdenum, the % carbon is not more than the median % carbon for a given % cobalt as defined by equations a) and b) or a) and c).

Nickel contributes to the hardenability of this alloy such that the alloy can be hardened with or without rapid quenching techniques. Nickel benefits the fracture toughness and stress corrosion cracking resistance provided by this alloy and contributes to the desired low ductile-to-brittle transition temperature. Accordingly, at least about 10.5%, better yet, at least about 10.75%, and preferably at least about 11.0% nickel is present. Above about 15% nickel the fracture toughness and impact toughness of the alloy can be adversely affected because the solubility of carbon in the alloy is reduced which may result in carbide precipitation in the grain boundaries when the alloy is cooled at a slow rate, such as when air cooled following forging. Preferably, nickel is limited to not more than about 13.5%, and better yet to not more than about 12.0%.

Other elements can be present in this alloy in amounts which do not detract from the desired properties. Not more than about 0.20% manganese can be present because manganese adversely affects the fracture toughness of the alloy. Preferably, manganese is restricted to about 0.15% max. and better yet to about 0.10% max. For best results the alloy contains not more than about 0.05% manganese. Up to about 0.1% silicon, up to about 0.01% aluminum, and up to about 0.02% titanium can be present as residuals from small additions for deoxidizing the alloy.

Small but effective amounts of elements that provide sulfide shape control are present in this alloy to benefit the fracture toughness by combining with sulfur to form sulfide inclusions that do not adversely affect fracture toughness. For example, the alloy can contain up to about 0.030% cerium and up to about 0.01% lanthanum. The preferred method of providing cerium and lanthanum in this alloy is through the addition of mischmetal during the melting process in an amount sufficient to recover effective amounts of cerium and lanthanum in the alloy. Effective amounts of cerium and lanthanum are present when the ratio Ce/S is at least about 2. When the Ce/S ratio is more than about 15, the hot workability and tensile ductility of the alloy are adversely affected. Preferably, the ratio Ce/S is not more than about 10. To ensure good hot workability, for example, when the alloy is to be press forged as opposed to being rotary forged, the alloy contains not more than about 0.01% cerium and not more than about 0.005% lanthanum. A small but effective amount of calcium can be present in this alloy in substitution for some or all of the cerium and lanthanum to benefit the fracture toughness provided by the alloy. Excellent results have been obtained when the alloy contains about 0.002% calcium. Other rare earth metals, magnesium, or yttrium can also be present in this alloy in place of some or all of the cerium, lanthanum, or calcium to provide the beneficial sulfide shape control.

The balance of the alloy according to the present invention is essentially iron except for the usual impurities found in commercial grades of alloys intended for similar service or use. The levels of such elements must be controlled so as not to adversely affect the desired properties of this alloy. For example, phosphorus is limited to not more than about 0.008%. Sulfur adversely affects the fracture toughness provided by this alloy. Accordingly, sulfur is restricted to about 0.0040% max., better yet to about 0.0025% max., and preferably to 0.0020% max. Best results are obtained when the alloy contains not more than about 0.001% sulfur. Tramp elements such as lead, tin, arsenic and antimony are limited to about 0.003% max. each, better yet to about 0.002% max. each, and preferably to about 0.001% max each. Oxygen is limited to not more than about 20 parts per million (ppm) and nitrogen to not more than about 40 ppm.

The alloy of the present invention is readily melted using conventional vacuum melting techniques. For best results, as when additional refining is desired, a multiple melting practice is preferred. The preferred practice is to melt a heat in a vacuum induction furnace (VIM) and cast the heat in the form of an electrode. The alloying addition for sulfide shape control referred to above is preferably made before the molten VIM heat is cast. The electrode is then remelted in a vacuum arc furnace (VAR) and recast into one or more ingots. Prior to VAR the electrode ingots are preferably stress relieved at about 1250 F for 4–16 hours and air cooled. After VAR the ingot is preferably homogenized at about 2150–2250 F for 6–24 hours.

The alloy can be hot worked from about 2250 F to about 1500 F. The preferred hot working practice is to forge an ingot from about 2150–2250 F to obtain at least a 30% reduction in cross sectional area. The ingot is then reheated to about 1800 F and further forged to obtain at least another 30% reduction in cross sectional area.

The alloy according to the present invention is austenitized and age hardened as follows. Austenitizing of the alloy is carried out by heating the alloy at about 1550–1650 F for about 1 hour plus about 5 minutes per inch of thickness and then quenching in oil. The hardenability of this alloy is good enough to permit air cooling or vacuum heat treatment with inert gas quenching, both of which have a slower cooling rate than oil quenching. Whatever quenching technique is used, the quench rate is preferably rapid enough to cool the alloy from the austenitizing temperature to about 150 F in about 2 h. When this alloy is to be oil quenched, however, it is preferably austenitized at about 1550–1600 F, whereas when the alloy is to be vacuum treated or air hardened it is preferably austenitized at about 1575–1650 F. After austenitizing, the alloy is preferably cold treated as by deep chilling at about −100 F for ½ to 1 hour and then warmed in air.

Age hardening of this alloy is preferably conducted by heating the alloy at about 850-925 F for about 5 hours followed by cooling in air. When austenitized and age hardened the alloy according to the present invention provides an ultimate tensile strength of at least about 280 ksi and longitudinal fracture toughness of at least about 100 ksi $\sqrt{in}$. Furthermore, the alloy can be aged within the foregoing process parameters to provide a Rockwell hardness of at least 54 HRC when it is desired for use in ballistically tolerant articles.

EXAMPLES

Five 4001 b VIM heats were prepared and each was split cast into two 2001 b VAR electrode-ingots. Prior to casting each of the electrode ingots a predetermined addition of mischmetal or calcium was added to the respective VIM heats. The amount of each addition was selected to result in a desired retained-amount after refining. The electrode-ingots were cooled in air, stress relieved at 1250 F for 16 h and then air cooled. The electrode-ingots were then refined by VAR and vermiculite cooled. The VAR ingots were stress relieved at 1250 F for 16 h and cooled in air. The compositions of the VAR ingots are set forth in weight percent in Table II below. Heats 1–7 are examples of the present invention and Heats A–C are comparative alloys.

TABLE II

| | Heat No. | | | | | | | | | |
|---|---|---|---|---|---|---|---|---|---|---|
| | 1 | 2 | 3 | 4 | 5 | 6 | 7 | A | B | C |
| C | .243 | .210 | .210 | .226 | .228 | .228 | .221 | .229 | .215 | .221 |
| Mn | <.01 | <.01 | <.01 | <.01 | <.01 | <.01 | <.01 | <.01 | <.01 | <.01 |
| Si | .01 | .01 | <.01 | .01 | .01 | .01 | .01 | .02 | <.01 | .01 |
| P | <.005 | <.005 | <.005 | <.005 | <.005 | <.005 | <.005 | <.005 | <.005 | <.005 |
| S | .0008 | .0006 | .0006 | .0007 | .0008 | .0007 | .0008 | .0009 | .0005 | <.0005 |
| Cr | 3.12 | 3.10 | 3.11 | 3.11 | 3.11 | 3.10 | 3.11 | 3.12 | 3.09 | 3.11 |
| Ni | 11.06 | 11.18 | 11.11 | 11.16 | 11.26 | 11.08 | 11.22 | 11.03 | 11.12 | 11.16 |
| Mo | 1.19 | 1.19 | 1.19 | 1.18 | 1.19 | 1.19 | 1.19 | 1.20 | 1.17 | 1.18 |
| Co | 13.46 | 13.52 | 13.48 | 13.46 | 13.48 | 13.49 | 13.51 | 13.45 | 13.47 | 13.50 |
| Ti | .01 | .01 | .01 | .01 | .01 | .01 | .01 | .01 | .01 | .01 |
| Al | <.01 | <.01 | <.01 | <.01 | <.01 | <.01 | <.01 | <.01 | <.01 | <.01 |
| Ce | .004 | .006 | .009 | .001 | <.001 | <.001 | .001 | .001 | .024 | .029 |
| La | .002 | .002 | .003 | <.001 | <.001 | <.001 | <.001 | <.001 | .005 | .006 |
| Ca | <.0010 | <.0010 | <.0010 | .002 | .002 | .002 | .002 | <.0010 | <.0010 | <.0010 |
| Ce/S | 5.0 | 10.0 | 15.0 | 1.4 | <1.2 | <1.4 | <1.2 | 1.1 | 48.0 | >58.0 |
| Fe | Bal. | Bal. | Bal. | Bal. | Bal. | Bal. | Bal. | Bal. | Bal. | Bal. |

Note:
The iron charge material was a high purity grade of electrolytic iron.

Prior to forging, the VAR ingots were homogenized at 2250 F for 6 h. The ingots were then press forged from the temperature of 2250 F to 3 in high by 5 in wide bars. The bars were reheated to 1800 F, press forged to 1-½ in×4in bars, and then cooled in air. The forged bars were annealed at 1250 F for 16 h and then air cooled.

Standard longitudinal tensile specimens (0.252 inch gage diameter by 1 in gage length) were machined from the annealed bars. The tensile specimens were austenitized in salt for 1 h at 1625 F, vermiculite cooled, deep chilled at −100 F for 1 h, and then warmed in air. The specimens were then age hardened for 5 h at 900 F and air cooled. Standard compact tension fracture toughness specimens were machined with a longitudinal orientation from the remains of the annealed bars. The fracture toughness specimens were austenitized, deep chilled, and age hardened in the same manner as the tensile specimens except for being air cooled from the austenitizing temperature.

The results of room temperature tensile tests on the duplicate specimens are shown in Table III including the 0.2% offset yield strength (0.2% Y.S.) and the ultimate tensile strength (U.T.S.) in ksi, as well as the percent elongation (% El.) and percent reduction in area (% R.A.) The results of room temperature fracture toughness testing in accordance with ASTM Standard Test E399 are also shown in Table III as $K_{IC}$ in ksi $\sqrt{in}$. Heats B and C were not tested because they could not be press forged.

TABLE III

| Ht. No. | % S | % Ce | % Ca | Ce/S | Longitudinal Mechanical Properties $K_{IC}$ | Y.S. | U.T.S. | % El. | % R.A. |
|---|---|---|---|---|---|---|---|---|---|
| 1 | .0008 | .004 | <.0010 | 5.0 | 117.4 | 262.1 | 291.3 | 16.4 | 66.2 |
| | | | | | 115.4 | 261.6 | 292.4 | 15.4 | 65.4 |
| 2 | .0006 | .006 | <.0010 | 10.0 | 117.2 | 260.1 | 289.3 | 15.3 | 67.1 |
| | | | | | 106.5 | 260.1 | 288.7 | 14.8 | 68.2 |
| 3 | .0006 | .009 | <.0010 | 15.0 | 109.8 | 260.5 | 289.0 | 13.4 | 63.6 |
| | | | | | 99.0 | 260.7 | 289.2 | 13.3 | 64.0 |
| 4 | .0007 | .001 | .002 | 1.4 | 130.3 | 255.5 | 283.0 | 13.3 | 69.2 |
| | | | | | 143.4 | 251.5 | 281.8 | 16.3 | 69.2 |
| 5 | .0008 | <.001 | .002 | <1.2 | 121.2 | 258.5 | 284.2 | 15.9 | 69.2 |
| | | | | | 116.0 | 257.5 | 283.2 | 15.3 | 68.4 |
| 6 | .0007 | <.001 | .002 | <1.4 | 119.8 | 255.6 | 283.0 | 15.5 | 69.0 |
| | | | | | 124.9 | 250.0 | 278.2 | 15.7 | 69.8 |
| 7 | .0008 | <.001 | .002 | <1.2 | 129.9 | 255.1 | 283.0 | 17.1 | 67.5 |
| | | | | | 122.2 | 251.0 | 275.9 | 16.4 | 69.3 |
| A | .0009 | .001 | <.0010 | 1.1 | 93.6 | 262.1 | 292.5 | 13.7 | 66.2 |
| | | | | | 86.5 | 265.6 | 294.5 | 15.1 | 65.4 |
| B | .0005 | .024 | <.0010 | 48.0 | — | — | — | — | — |
| C | <.0005 | .029 | <.0010 | >58.0 | — | — | — | — | — |

The data of Table III show that the alloy according to the present invention provides an ultimate tensile strength of at least 280 ksi in combination with high fracture toughness as represented by a $K_{IC}$ of at least about 100 ksi $\sqrt{in}$.

The alloy according to the present invention is useful in a variety of applications requiring high strength and low weight, for example, aircraft landing gear components; aircraft structural members, such as braces, beams, struts, etc.; helicopter rotor shafts and masts; and other aircraft structural components which are subject to high stress in service. The alloy of the present invention could be suitable for use in jet engine shafts. This alloy can also be aged to very high hardness which makes it suitable for use as lightweight armor and in structural components which must be ballistically tolerant. The present alloy is, of course, suitable for use in a variety of product forms including billets, bars, tubes, plate and sheet.

It is apparent from the foregoing description and accompanying examples, that the alloy according to the present invention provides a unique combination of tensile strength and fracture toughness not provided by known alloys. This alloy is well suited to applications where high strength and low weight are required. The present alloy has a low ductile-to-brittle transition temperature which renders it highly useful in applications where the in-service temperatures are well below zero degrees Fahrenheit. Because this alloy can be vacuum heat treated, it is particularly advantageous for use in the manufacture of complex, close tolerance components. Vacuum heat treatment of such articles is desirable because the articles do not undergo any distortion as usually results from oil quenching of such articles made from known alloys.

The terms and expressions which have been employed herein are use as terms of decription and not of limitation. There is no intention in the use of such terms and expressions to exclude any equivalents of the features described or any portions thereof It is recognized, however, that various modifications are possible within the scope of the invention claimed.

What is claimed is:

1. An age hardenable, martensitic steel alloy which provides high strength and high fracture toughness, said alloy consisting essentially of, in weight percent, about

| | wt. % |
|---|---|
| Carbon | 0.2–0.33 |
| Manganese | 0.20 max. |
| Sulfur | 0.004 max. |
| Chromium | 2–4 |
| Nickel | 10.5–15 |
| Molybdenum | 0.75–1.75 |
| Cobalt | 8–17 |
| Cerium | 0.030 max. |
| Lanthanum | 0.01 max. |

and the balance is essentially iron, wherein the ratio Ce/S is at least about 2.

2. An alloy as set forth in claim 1 containing at least about 0.20% carbon.

3. An alloy as set forth in claim 1 containing at least about 10.75% nickel.

4. An alloy as set forth in claim 1 wherein the ratio Ce/S is not more than about 15.

5. An alloy as set forth in claim 1 wherein a) % Co≦35–81.8(% C).

6. An alloy as set forth in claim 5 wherein b) % Co≧25 5–70(% C).

7. An alloy as set forth in claim 6 wherein when % Mo>1.3, % C is not more than the median % C for a given % Co as defined by relationships a) and b).

8. An alloy as set forth in claim 5 wherein c) % Co≧26.9–70(% C).

9. An alloy as set forth in claim 8 wherein when % Mo>1.3, % C is not more than the median % C for a given % Co as defined by relationships a) and c).

10. An alloy as set forth in claim 1 containing about 0.15% max. manganese.

11. An alloy as set forth in claim 1 containing calcium in substitution for at least a portion of the cerium and lanthanum.

12. An age-hardenable, martensitic steel alloy which provides high strength and high fracture toughness, said alloy consisting essentially of, in weight percent, about

| | wt. % |
|---|---|
| Carbon | 0.20–0.31 |
| Manganese | 0.15 max. |
| Sulfur | 0.0025 max. |
| Chromium | 2.25–3.5 |
| Nickel | 10.75–13.5 |
| Molybdenum | 0.75–1.5 |
| Cobalt | 10–15 |
| Cerium | 0.030 max. |
| Lanthanum | 0.01 max. |

and the balance is essentially iron, wherein the ratio Ce/S is at least about 2.

13. An alloy as set forth in claim 12 containing at least about 0.21% carbon.

14. An alloy as set forth in claim 12 containing at least about 11.0% nickel.

15. An alloy as set forth in claim 12 wherein the ratio Ce/S is not more than about 15.

16. An alloy as set forth in claim 12 containing about 0.10% max. manganese.

17. An age-hardenable, martensitic steel alloy which provides high strength and high fracture toughness, said alloy consisting essentially of, in weight percent, about

| | wt. % |
|---|---|
| Carbon | 0.21–0.27 |
| Manganese | 0.05 max. |
| Silicon | 0.1 max. |
| Phosphorus | 0.008 max. |
| Sulfur | 0.0020 max. |
| Chromium | 2.5–3.3 |
| Nickel | 11.0–12.0 |
| Molybdenum | 1.0–1.3 |
| Cobalt | 11–14 |
| Cerium | 0.01 max. |

-continued

| | wt. % |
|---|---|
| Lanthanum | 0.01 max. |

and the balance is essentially iron wherein Ce/S is about 2–10.

18. An alloy as set forth in claim 17 wherein a) % Co≦35–81.8(% C).

19. An alloy as set forth in claim 18 wherein b) % CO≧25.5–70(% C).

20. An alloy as set forth in claim 17 containing calcium in substitution for at least a portion of the cerium and lanthanum.

21. An age-hardened article having high strength and high fracture toughness, said article being formed of a martensitic steel alloy consisting essentially of, in weight percent, about

| | wt. % |
|---|---|
| Carbon | 0.2–0.33 |
| Manganese | 0.15 max. |
| Silicon | 0.1 max. |
| Phosphorus | 0.008 max. |
| Sulfur | 0.004 max. |
| Chromium | 2–4 |
| Nickel | 10.5–15 |
| Molybdenum | 0.75–1.75 |
| Cobalt | 8–17 |
| Cerium | 0.030 max. |
| Lanthanum | 0.01 max. |

and the balance essentially iron wherein Ce/S is about 2–15, said article being characterized by a longitudinal, room temperature, tensile strength of at least about 280 ksi and a room temperature, longitudinal, $K_{IC}$ fracture toughness of at least about 100 ksi $\sqrt{in}$.

22. An article as set forth in claim 21 wherein the alloy contains at least about 0.21% carbon.

23. An article as set forth in claim 21 wherein the alloy contains at least about 11.0% nickel.

24. An article as set forth in claim 21 wherein a) % Co≦35–81.8(% C).

25. An article as set forth in claim 24 wherein b) % Co≧25.5–70(% C).

26. An article as set forth in claim 25 wherein when % Mo>1.3, % C is not more than the median % C for a given % Co as defined by relationships a) and b).

27. An article as set forth in claim 21 wherein the alloy contains not more than about 0.05% manganese.

* * * * *